United States Patent [19]

Litvin et al.

[11] 4,429,554

[45] Feb. 7, 1984

[54] BILATERAL KEY FOR CYLINDER LOCK

[76] Inventors: Noel Litvin; Abraham I. Scherz, both of Leiva 4675, Buenos Aires, Argentina

[21] Appl. No.: 306,897

[22] Filed: Sep. 29, 1981

[30] Foreign Application Priority Data

Apr. 8, 1981 [AR] Argentina ..... 282463

[51] Int. Cl.[3] ..... E05B 27/06

[52] U.S. Cl. ..... 70/358; 70/364 A; 70/395

[58] Field of Search ..... 70/358, 364 A, 395, 70/399, 400

[56] References Cited

U.S. PATENT DOCUMENTS 1,662,613 3/1928 Laynor ..... 70/395
1,979,798 11/1934 Glidden ..... 70/395
2,620,649 12/1952 Bernardo ..... 70/358
3,968,668 7/1976 Epstein ..... 70/364 A

FOREIGN PATENT DOCUMENTS 29137 4/1912 United Kingdom ..... 70/399

*Primary Examiner*—Robert L. Wolfe
*Attorney, Agent, or Firm*—Scully, Scott, Murphy & Presser

[57] ABSTRACT

A bilateral key for a cylinder lock which has more than one row of tumbler pins thereby requiring a key having a number of generally parallel tumbler activation edges corresponding to the number of rows of tumbler pins. The key is formed of blade components having an exterior end and an operative end with an edge containing projections and depressions and a means for attaching the blade components securely together so that the edges are aligned to cooperatively form the lock combination of the cylinder lock.

4 Claims, 6 Drawing Figures

BILATERAL KEY FOR CYLINDER LOCK

BACKGROUND OF THE INVENTION

The present invention relates to the art of key design and, in particular, to a new key designed for use in a cylinder lock of the type which contain at least two rows of tumbler pins which must be displaced to form the locking combination.

In the field of locking mechanisms constant efforts are made to improve locking combination characteristics, such as operability and security against unwanted openings. To this end, there has been developed in the area of cylinder locks the combination of more than one linear row of tumbler pins so that the proper locking combination may only be effected by the simultaneous displacement of more than one row of tumbler pins to their respective correct locking combination positions. Consequently, in order to achieve this simultaneous displacement, a key must be used which has more than one edge formed with the appropriate projections and depressions to move the tumbler pins to their proper locking combination positions.

Multiple-edge keys designed to operate cylinder locks having multiple rows of tumbler pins present certain problems in both fabrication and especially in reproduction. As is appreciated from simple observation of any key, the projections and depressions formed on the operative edge are of different magnitude. Thus, when two or more operating edges are arranged side by side, not only are the projections and depressions of the respective edges noncoincidental, but the magnitudes of the parallel projections and depressions will also be incongruous. This structural characteristic prevents normal cutting of a straight edge of a blank key blade since such cutting, usually performed with a grinding wheel, is indiscriminate with regard to lateral distance transverse to the operative edge. As a result, use of multiple-edge keys and, consequently, cylinder locks of the type requiring multiple-edge keys are severely limited.

It is the object of the present invention to overcome the difficulties described above and others associated with use of cylinder locks having more than one row of tumbler pins which must be displaced to effect the locking combination.

SUMMARY OF THE INVENTION

The present invention is a bilateral key for a cylinder which includes more than one row of tumbler pins thereby requiring a key having a number of generally parallel tumbler activation edges corresponding to the number of rows of tumbler pins. Each of the activation edges are formed with projections and depressions for displacing the tumbler pins to their appropriate lock combination positions. According to the present invention, the bilateral key comprises at least two blade components each of which has an exterior end and an operative end with an edge containing projections and depressions for establishment tumbler pin displacement, and a means for attaching the blade components securely together so that the edges are aligned to cooperatively form the unique lock combination of the cylinder lock.

In one preferred embodiment the means for attaching consists of two connectors located on the end of the key opposite the edges. One connector is adjacent the exterior end and allows rotational movement of the blade components relative to each other. A second connector, located between the first connector and the operative blade end, is detachable so that upon removal of the second connector, the blade components are free to be angularly displaced from each other around the first connector.

In another preferred embodiment the means of attachment includes two connectors arranged linearly distant from one another so that upon removal of the connectors, the blade components may be wholly detached from the other so that they may be laterally removed away from each other.

For a better understanding of the present invention, together with other and further objects, reference is made to the following description, taken in conjunction with the accompanying drawings, and its scope will be pointed out in the appended claims.

DETAILED DESCRIPTION OF THE INVENTION

Figure 1:
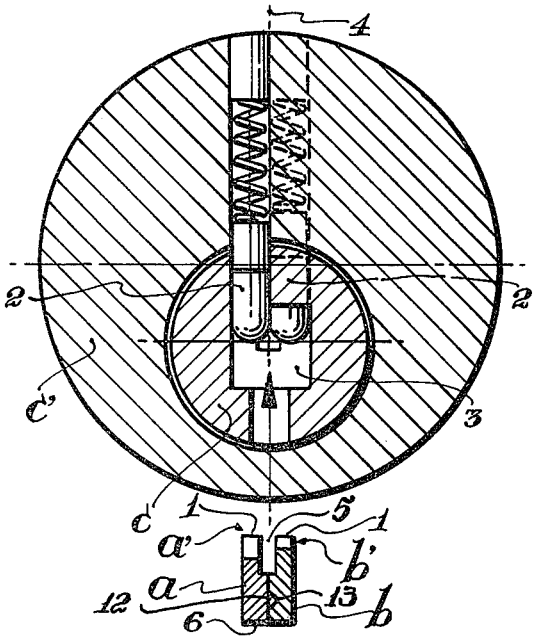
FIG. 1 is an elevated cross-section of the cylinder lock and corresponding bilateral key according to the present invention.
Figure 2:
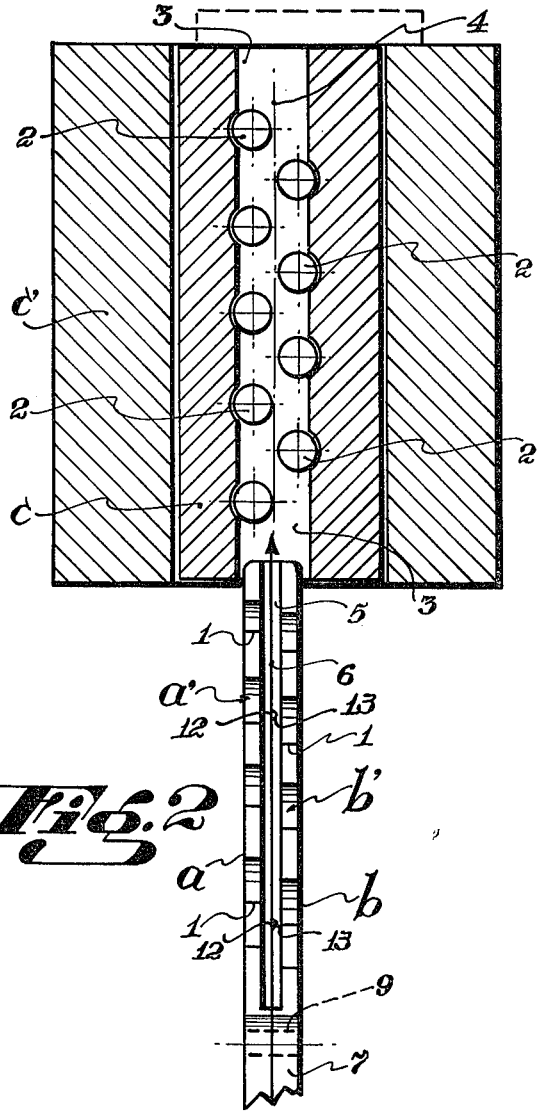
FIG. 2 is a cross-section of the top of the cylinder lock and key of the present invention.

Referring to the drawing, the bilateral key of the present invention has two blade components a and b, each of which are formed with projections a′ and b′ and depressions 1. In the operative mode, the blade components are arranged immediately adjacent each other at lower contact flanges 6 so that upon being united the operative shaft of the bilateral key has a groove 5 and a cross-sectional profile which coincides with the cross-section of the keyhole 3 in cylinder c.

Cylinder lock c′ is shown herein with two rows of tumbler pins 2 having a center line 4. The pins 2 are staggered and are tangent or slightly secant in relation to the center line 4 so that the pins 2 are placed in two parallel lines at a minimum distance from each other. Upon insertion of the shaft of the bilateral key into keyhole 3, tumbler pins 2 are displaced according to the projections a′ and b′, and depressions 1, so that when the proper key is used cylinder 3′ is free to rotate within cylinder lock 3.

Figure 3:
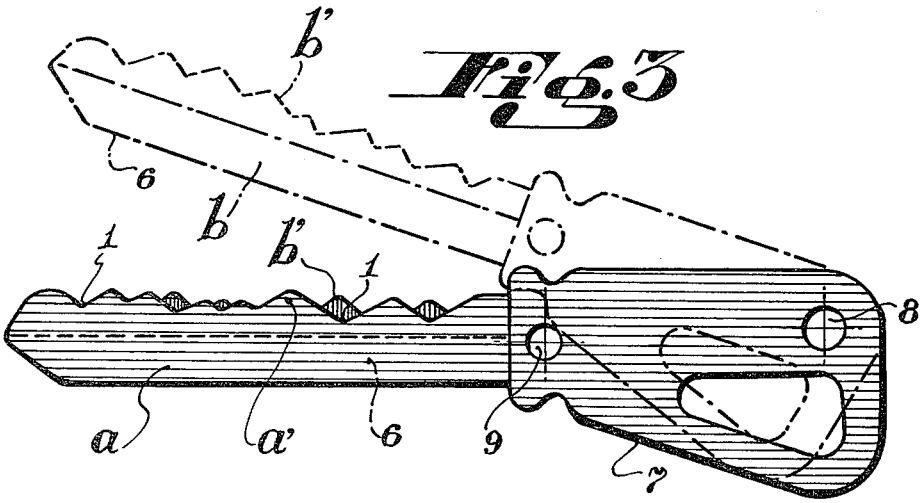
FIG. 3 is an elevated side view of the bilateral key of the invention shown with a phantom displacement of one blade.
Figure 4:
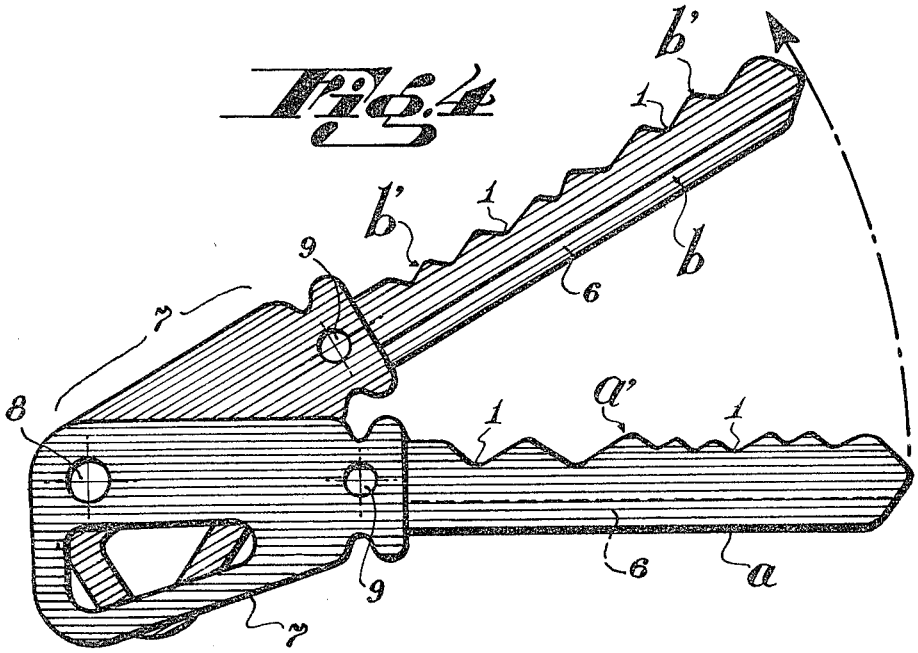
FIG. 4 is a plan view of the bilateral key shown with an angular displacement.

In the embodiment shown in FIGS. 1–6, blade components a and b are also formed with finger grips 7 to hold and handle the key as a unit. The embodiment of FIGS 1–4 also includes connecting elements 8 and 9 which, when simultaneously attached, hold the key together as a single element. In FIG. 4 the blade components are shown angularly displaced relative to each other which may occur when connecting element 9 is removed and connecting element 8 is retained. This ability to angularly displace the blade components allow the two components a and b to be independently cut by normal key cutting means, such as a grinding wheel, without interference from the other blade component.

Figure 5:
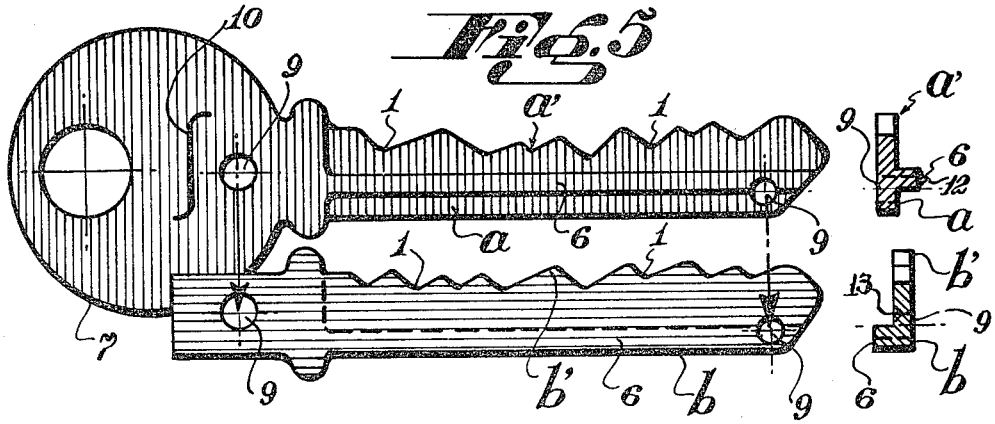
FIGS. 5 and 6 depict a different embodiment of the bilateral key of the invention in which the two blade components are slideably detachable.
Figure 6:
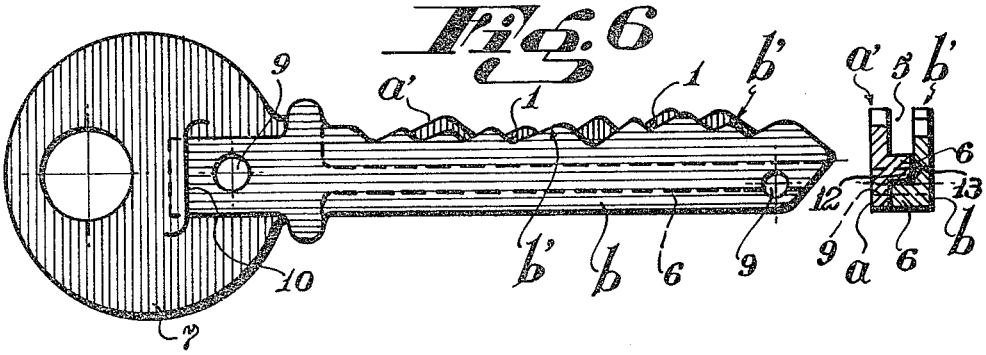

In FIGS. 5 and 6 the blade components are slideably detachable and may be secured by connecting elements 9 and opening 10, which is designed to receive the rear extension of blade component 6. In order to effect cutting such as, for instance, to copy or reproduce a blade component, it is necessary to completely separate the components as in FIG. 5.

In all embodiments shown herein, assembly of the key is conveniently accomplished by fitting male element 12 into female element 13, which are arranged linearly along the blade components a and b, respectively, together thereby securing the blade components in the operative position.

It is believed after testing the bilateral key herein for ease in effecting reproduction or copying, the most practical configuration is that of FIGS. 3 and 4, wherein connecting element 8 serves as an axis around which the blade components are allowed to rotate in order to copy each blade without interference from the other blade component. Thus, after copying the projections a′ and b′ and depressions 1 of each of the individual blade components, the components are swung back into lateral alignment with each other whereupon male element 12 is fitted to female element 13 and connecting element 9 is fixed to the blade components to secure them in the operative mode.

While there have been described what are presently believed to be the preferred embodiments of the invention, those skilled in the art will realize that changes and modifications may be made thereto without departing from the spirit of the invention, and it is intended to claim all such changes and modifications as fall within the true scope of the invention.

We claim:

1. A bilateral key for a cylinder lock which has more than one row of tumbler pins, thereby requiring a key having a number of generally parallel tumbler operating edges corresponding to the number of rows of tumblers with a plurality of depressions formed therein for displacing the tumbler pins to the lock combination position, said key comprising:

(a) at least first and second blade components, each of said blades having an exterior end and an operative end, each of said blades also defining along one edge thereof, an operating edge for selectively displacing tumbler pins in a cylinder lock;

(b) a means for detachably securing said blades together;

(i) said means providing for displacement of the blades for selectively and differentially cutting a plurality of projections and recesses in each of the operating edges;

(ii) said means also securing said blades together in a side by side relationship with the respective operating edges adjacent one another;

whereby said operating edges may be separated for selectively and differentially cutting the edges and secured together to form a bilateral key to cooperatively displace rows of tumbler pins in a cylinder lock when inserted therein.

2. The bilateral key described in claim 1, wherein said means for detachably securing said blade components comprises a first connector adjacent said exterior end which rotatably connects said blades and a second connector located on said exterior end at a point more proximal to said operative end than said first connector so that said blade components are angularly movable relative to each other around said first connector upon removal of said second connector.

3. The bilateral key described in claim 5, wherein said means for detachably securing said blade components comprises at least two connectors which may be removed so that said blade components are separable from each other.

4. The bilateral key described in claim 1, wherein said blade components are formed with complementary male and female members arranged linearly along said blade components thereby fixing said edges during operation of said key.

* * * * *

UNITED STATES PATENT AND TRADEMARK OFFICE

CERTIFICATE OF CORRECTION

PATENT NO. : 4,429,554

DATED : February 7, 1984

INVENTOR(S) : Noel Litvin et al

It is certified that error appears in the above-identified patent and that said Letters Patent is hereby corrected as shown below:

Column 4, claim 3, line 31, "5" should read -- 1 --.

Signed and Sealed this

*Twenty-second* Day of *May 1984*

[SEAL]

*Attest:*

GERALD J. MOSSINGHOFF

*Attesting Officer*

*Commissioner of Patents and Trademarks*